US006743096B2

(12) United States Patent
Allendorf et al.

(10) Patent No.: US 6,743,096 B2
(45) Date of Patent: Jun. 1, 2004

(54) GAMING DEVICE AND METHOD HAVING AN INTERNALLY-BASED COMPETITION-TYPE BONUS EVENT

(75) Inventors: Todd Allendorf, Las Vegas, NV (US); Jay Stone, Las Vegas, NV (US); Steven A. Weiss, Las Vegas, NV (US); Scott Stewart, Las Vegas, NV (US)

(73) Assignee: Aristocrat Technologies Australia Pty Ltd (AU)

( * ) Notice: Subject to any disclaimer, the term of this patent is extended or adjusted under 35 U.S.C. 154(b) by 0 days.

(21) Appl. No.: 09/967,743

(22) Filed: Sep. 28, 2001

(65) Prior Publication Data

US 2003/0062678 A1 Apr. 3, 2003

(51) Int. Cl.[7] ..... A63F 9/24

(52) U.S. Cl. ..... 463/25; 273/292; 273/138.1; 463/16

(58) Field of Search ..... 273/292, 153.5, 273/248, 249, 243, 242, 236, 156, 138.1, 139; 463/10, 6, 7, 12, 13, 20, 16, 40–42, 23, 25

(56) References Cited

U.S. PATENT DOCUMENTS 2,671,662 A * 3/1954 Carpentar et al. ..... 463/62
5,126,717 A * 6/1992 Renaud et al. ..... 340/323 R
5,560,603 A * 10/1996 Seelig et al. ..... 463/6
5,642,886 A * 7/1997 Yancey, Jr. ..... 273/408
5,664,998 A * 9/1997 Seelig et al. ..... 463/20
5,779,544 A * 7/1998 Seelig et al. ..... 463/6
5,823,872 A * 10/1998 Prather et al. ..... 237/242
5,938,200 A * 8/1999 Markowicz et al. ..... 273/246
5,941,770 A * 8/1999 Miers et al. ..... 463/13
5,976,015 A * 11/1999 Seelig et al. ..... 463/6
5,997,400 A * 12/1999 Seelig et al. ..... 463/6
6,203,429 B1 * 3/2001 Demar et al. ..... 273/143 R
6,210,275 B1 * 4/2001 Olsen ..... 463/16
6,261,177 B1 * 7/2001 Bennett ..... 463/16
6,290,600 B1 * 9/2001 Glasson ..... 273/143 R
6,305,686 B1 * 10/2001 Perrie et al. ..... 273/142 R
6,309,299 B1 * 10/2001 Weiss ..... 273/108.1
6,315,660 B1 * 11/2001 DeMar et al. ..... 273/138.2
6,409,172 B1 * 6/2002 Vancura ..... 273/256
6,461,241 B1 * 10/2002 Webb et al. ..... 463/20
2002/0016200 A1 * 2/2002 Baerlocher et al. ..... 463/20

FOREIGN PATENT DOCUMENTS

EP 219305 A2 * 4/1987 ..... G07F/17/34

* cited by examiner

*Primary Examiner*—S. Thomas Hughes
*Assistant Examiner*—Alex F. R. P. Rada, II
(74) *Attorney, Agent, or Firm*—Bernhard Kreten

(57) ABSTRACT

A method and device for gaming, in which a primary game is played toward a winning outcome, but including a bonus event triggered by a particular outcome or outcomes. The bonus event is characterized by allowance of play against the device to earn awards, the magnitude of such awards to be determined by the relative final successes based on simulated competition between the player and the device.

5 Claims, 4 Drawing Sheets

GAMING DEVICE AND METHOD HAVING AN INTERNALLY-BASED COMPETITION-TYPE BONUS EVENT

FIELD OF THE INVENTION

The following invention is generally related to instrumentalities and methodologies in gaming devices. More specifically, the instant invention is directed to a gaming device having a primary game having not only a winning outcome, but also a triggering outcome for a bonus event. Most specifically, the bonus event allows play against the device in which the relative success of the player against the device determines the magnitude of the award.

BACKGROUND OF THE INVENTION

Traditional board-style games indicate the presence of competition by assigning symbols or tokens to each player, who competes against the others. All who play know that they are competing against others; the playfield depicted on the board indicates the progress or success of each player against other players. Conversely, traditional machine-based gaming, such as slot machines or video poker games, offer only solitary gaming propositions. While a player may in actuality compete against the house, or additionally compete against other players to win the same jackpot, as in progressive games, no physical representation exists to retain player interest and encourage competitive spirit within a stand-alone game.

While several manufacturers have developed "bonus" games to retain players, these bonus games continue the solitary gaming theme, allowing the player merely to play a different game in a solitary atmosphere. A game that utilizes visual stimulus to display progress against an opponent appeals to natural human instincts by engaging a player's sense of competition, and is therefore very likely to retain interest.

SUMMARY OF THE INVENTION

The present invention is distinguishable over the prior art in a multiplicity of ways. For example, the instant invention provides an event, especially a bonus event that allows a player to compete with the device in a manner that mimics group-based board games, rather than reinforcing the solitariness of traditional machine-based gaming propositions.

Further, the instant invention allows the player to earn enhanced awards which are outcome-determinative relative to motion on the playfield of the bonus event.

OBJECTS OF THE INVENTION

Accordingly, it is a primary object of the present invention to provide a new and novel device and method for gaming, in which a player is offered a secondary gaming proposition for more chances at success.

It is a further object of the present invention to provide a device and method as characterized above which provides an opportunity for the player to compete with the device to determine the magnitude of any award generated.

It is a further object of the present invention to provide a device and method as characterized above that is more enjoyable, in which a player visualizes the device as an opponent, rather than merely an solitary gaming implement.

Viewed from a first vantage point, it is an object of the present invention to provide a gaming device, comprising, in combination: a display, and a processor and random number generator operatively intercoupled and operatively coupled to said display, said random number generator providing an outcome to a primary game initiated on said display, said display having at least one outcome triggering a bonus event, said bonus event allowing play of a gaming proposition in which the device is represented as an opponent, said play occurring as a function of random means, and wherein an award is generated based on relative final success against said opponent in said bonus event.

Viewed from a second vantage point, it is an object of the present invention to provide A method for gaming, the steps including: causing a player symbol to traverse a course as a function of incremental steps, crediting a player's account incrementally as a function of the steps, and competing against a simulated opponent while traversing the course.

These and other objects will be made manifest when considering the following detailed specification when taken in conjunction with the appended drawing figures.

DESCRIPTION OF PREFERRED EMBODIMENTS

Figure 2:
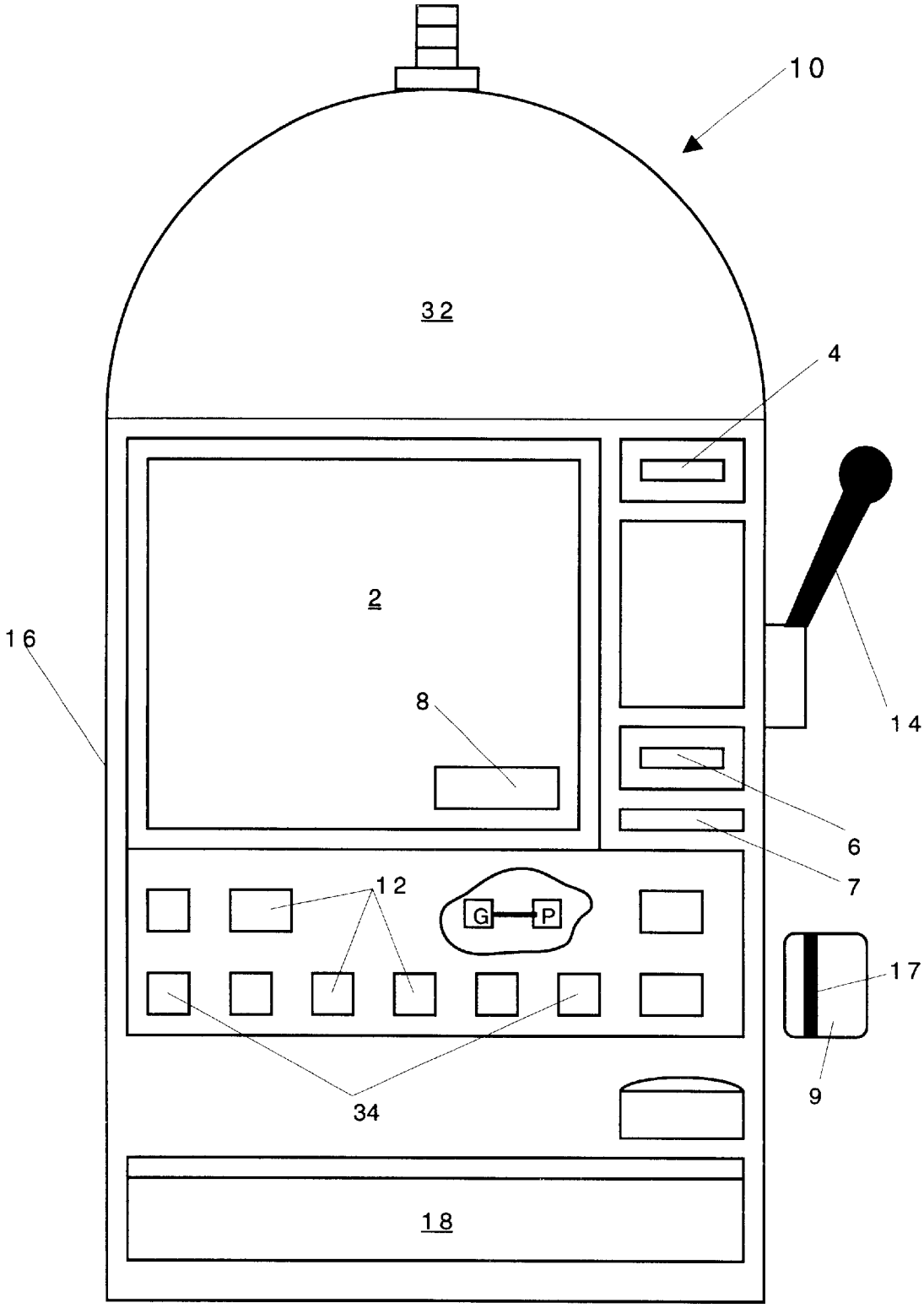
FIG. 2 is a depiction of the apparatus associated therewith.

Considering the drawings, wherein like reference numerals denote like parts throughout the various drawing figures, reference numeral 10 as shown in FIG. 2 is directed to the device according to the present invention.

In its essence, the device 10 includes a housing 16 which supports a visual display 2, preferably a video monitor, therewithin. The display 2 may include a window 8 for special messages or for incrementing counting of credits accumulated by the player. The device also includes an LED readout 4 for prompting the player and can provide similar verbiage as the window 8 or in lieu thereof, to stimulate the player. The device includes an inlet 6 for the reception therein for coins, currency or the like to auger in the inception of play. A plurality of decision-making buttons 12 are located on the face of the apparatus 10, preferable below the display 2 and a pull handle 14 can be used to initiate play as an alternative to supplement the decision-making buttons 12. A coin hopper 18 may be included to effectuate an output of an award due the player. The device 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes. A card 9, having a read/write instrumentality 17 thereon, can be read via input 7 as a substitute for or supplement to credit transfers as well as player identification.

Figure 1:
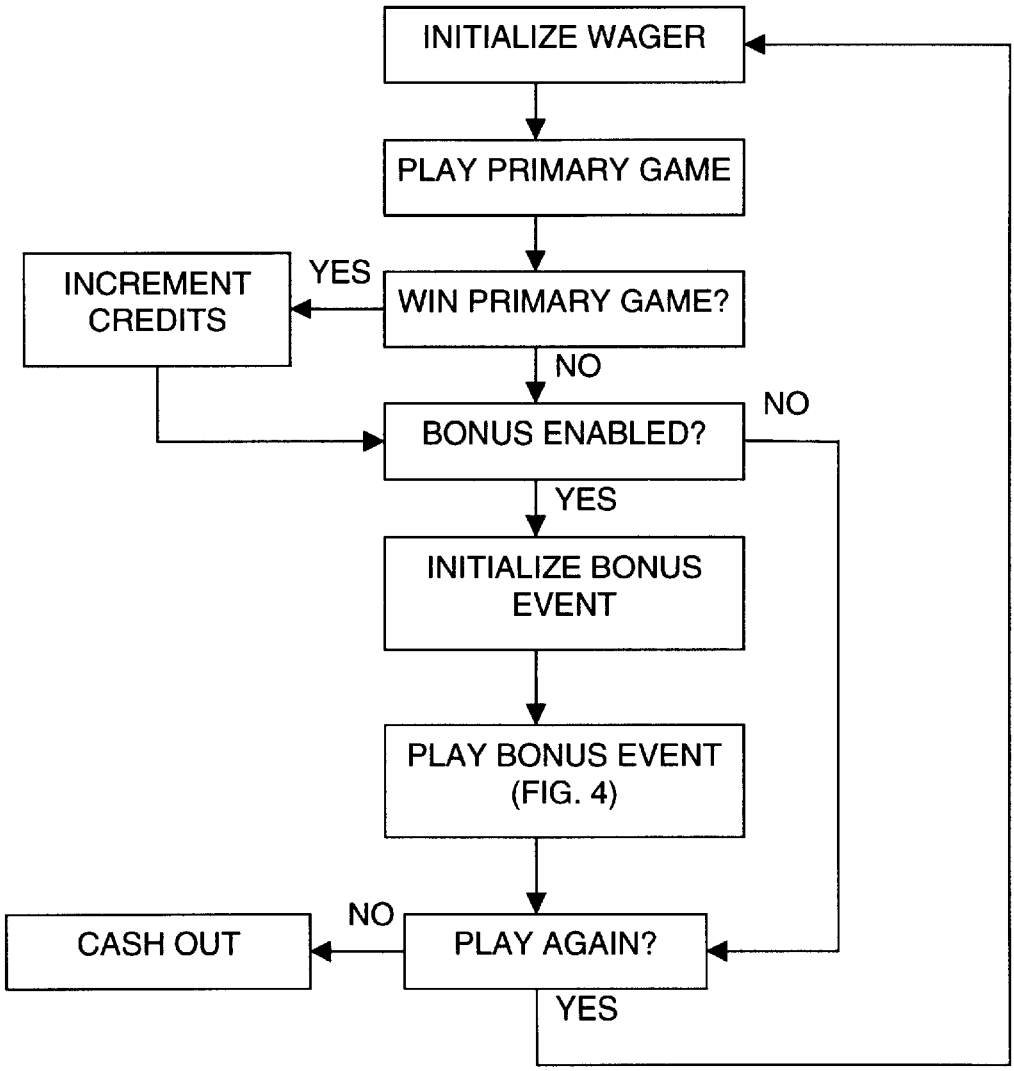
FIG. 1 is a flowchart of the methodology according to the present invention.
Figure 3:
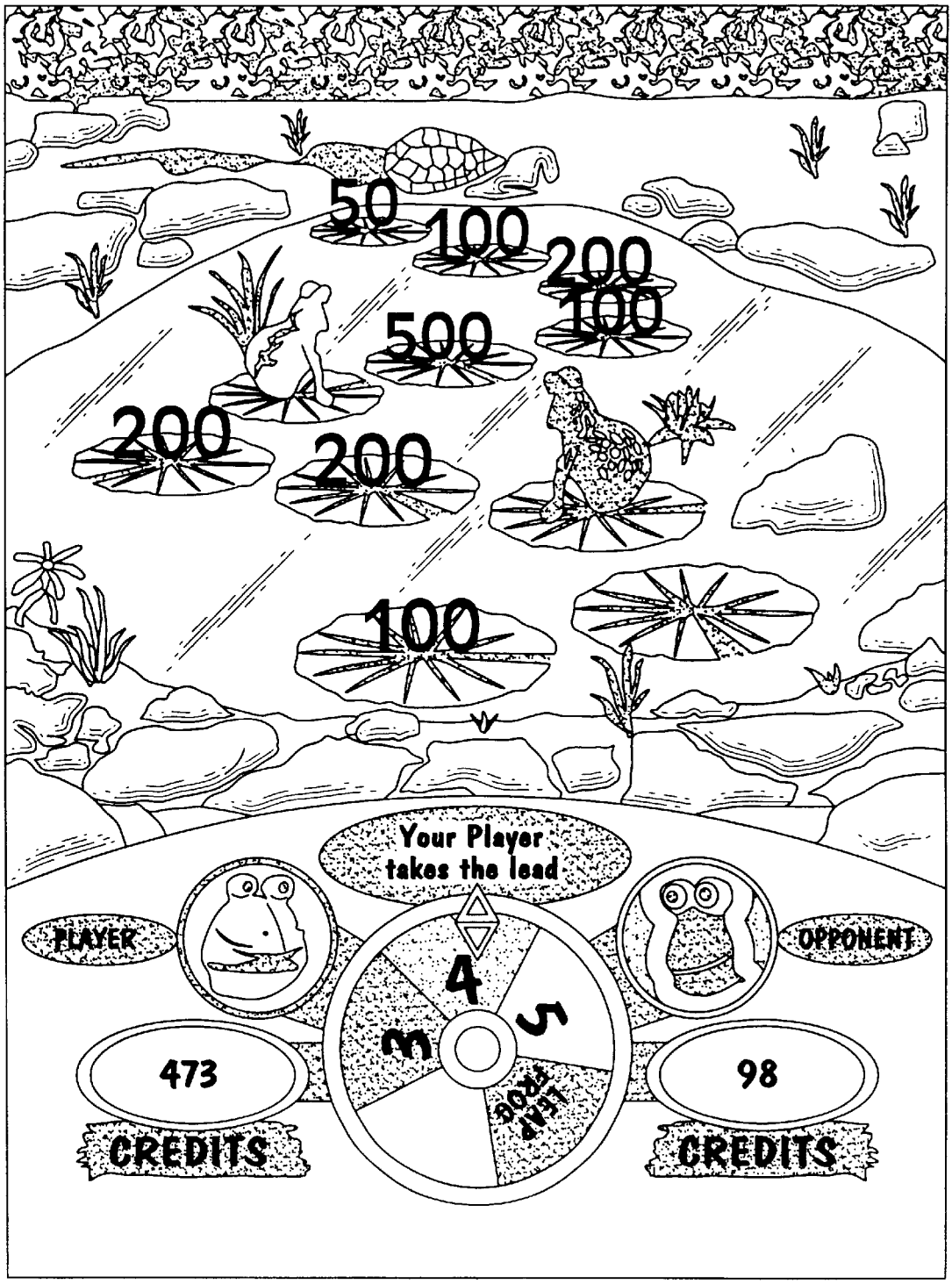
FIG. 3 is a depiction of a bonus screen according to the present invention.

Referring to FIG. 1, the flowchart associated with the apparatus of FIGS. 2 and 3 can be explored. Initially, the player plays the game with a maximum bet or less. Preferably, but optionally, a maximum bet enables the features of the invention. Assume a maximum bet is required. If the player plays with less than a maximum bet, the ultimate outcome is determined by the symbols of the initial outcome. If the player opts to play with a maximum bet, then after the initial outcome is displayed, the player is immediately rewarded if the initial outcome corresponds to a value on an associated paytable. Whether or not the player wins, the initial outcome is compared to a predetemined set of outcomes that trigger a bonus event.

Figure 4:
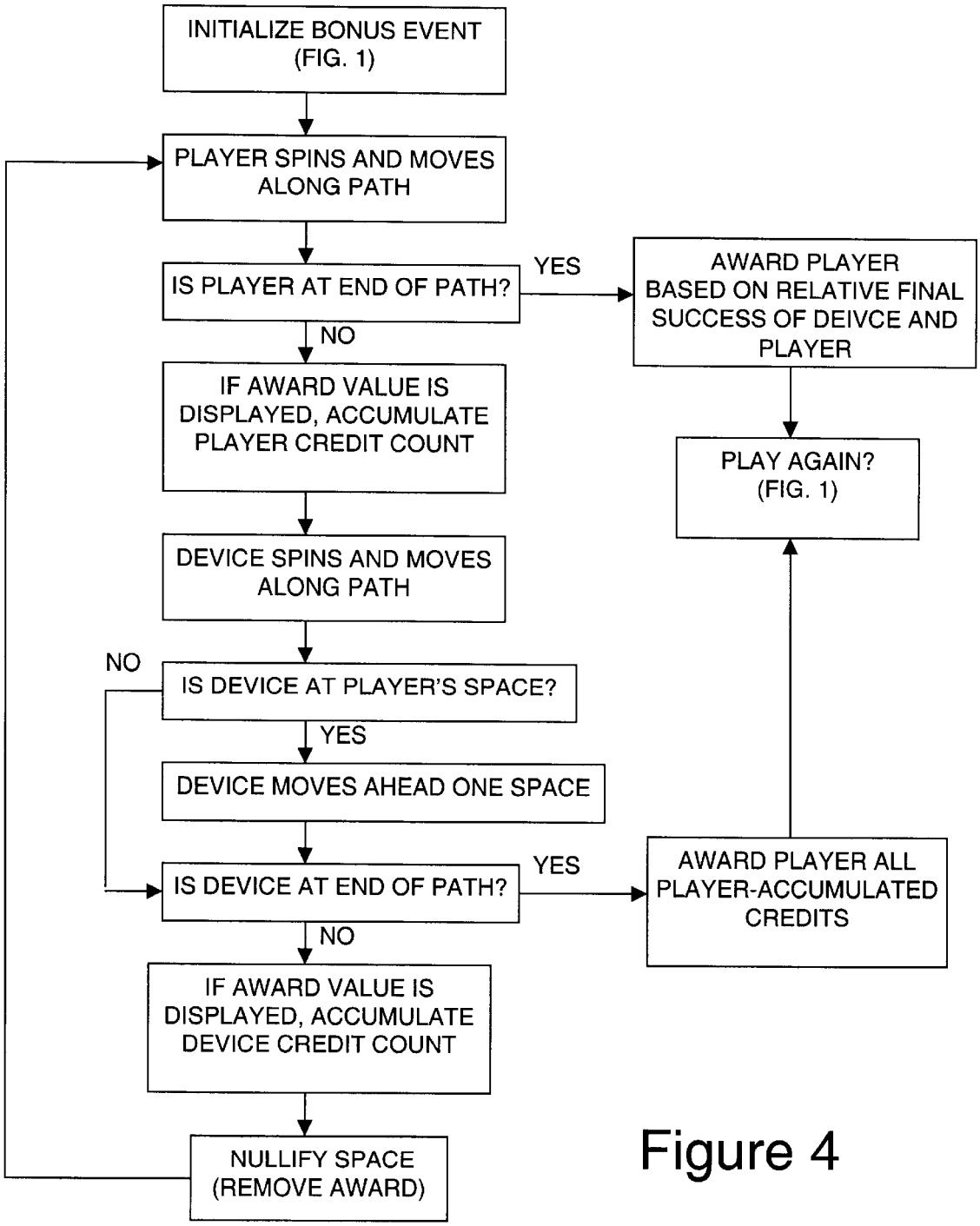
FIG. 4 is a flowchart of the methodology of the bonus event.

More specifically, and with reference to FIG. 3 and the flowchart of FIG. 4, greater details with respect to the video display 2 with regard to the bonus event of the preferred embodiment can be explored. The display 2 features a bonus event playfield, depicted in FIG. 3, in which the player and the device are each depicted as a symbol or token. For example, in FIG. 3, the chosen symbol to represent the player and the device are frogs. The playfield for the bonus event is preferably shown as a path embodied as lilypads, with all or a subset of the path spaces displaying award values. Play occurs by way of a random number generator, shown in FIG. 3 as a spinner, allowing the symbols of the player and the device to travel on the path shown. When a symbol lands on a space containing an award value, that value is credited to the symbol that landed upon it. Play alternates between the player and the device, and continues until one symbol reaches the end of the path. If the player's symbol reaches the end of the path first, the player is awarded the sum of the credits accumulated on the path by his symbol and by the device's symbol. If the device's symbol reaches the end of the path first, the player is awarded only the credits accumulated on the path by the player's symbol. Additionally, the preferred embodiment contemplates the annulment of spaces on which the device's symbol lands. This means that if the player subsequently lands on the same space as the device's symbol, the potential for credits will have been extinguished. Also, if either symbol lands on the same (occupied) place as the other's symbol, the device's symbol will "skip over" (leapfrog) the space occupied by that symbol and occupy the next space, removing its value. Thus, any space on which the player's symbol lands that has already been occupied by the device's symbol will provide no award to the player unless the player wins the race to the finish line.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming device, comprising, in combination:

a display, and a processor and random number generator operatively intercoupled and operatively coupled to said display, said random number generator providing an outcome to a primary game initiated on said display, said display having at least one outcome triggering a subsequent bonus event, said subsequent bonus event allowing play of a gaming proposition against the device, wherein the device is tangibly represented as an opponent, said play occurring as a function of random means, and wherein an award is generated based on relative final success against said opponent in said subsequent bonus event, and wherein said bonus event further comprises a path to be traversed by a player and a plurality of credit indicia along said path, wherein said award of credits is dependent on encountering said credit indicia along said path wherein said award of credits is the difference between the values of the credit indicia encountered by the player and the credit indicia encountered by the device along said path.

2. A method for gaming, the steps including:

displaying a path to be traversed;

populating the path with credit indicia;

commencing travel along the path, wherein a player and a simulated opponent are represented by symbols;

traveling along said path in incremental steps and accumulating said credit indicia until said path terminates, awarding credits to the player, based on accumulated credit indicia, as a function of success relative to said simulated opponent;

representing the player and the simulated opponent by frog symbols, wherein said frog symbols represented by frog symbols alternate turns;

calculating an award of credits, wherein said award comprises the sum of said credit indicia landed upon by the frog symbol representing the player; and dispensing said award of credits to the player.

3. The method of claim 2, further including the step of adjusting said awarding of credits by subtracting the sum of said credit indicia landed upon by the symbol representing said simulated opponent from said award of credits, wherein the adjusting step occurs before the dispensing step.

4. A gaming device, comprising, in combination:

a display, and a processor and random number generator operatively intercoupled and operatively coupled to said display, said random number generator providing an outcome to a primary game initiated on said display, said display having at least one outcome triggering a subsequent bonus event, said subsequent bonus event allowing play of a gaming proposition against the device, wherein the device is tangibly represented as an opponent, said play occurring as a function of random means, and wherein an award is generated based on relative final success against said opponent in paid subsequent bonus event wherein said bonus event further comprises a path to be traversed by a player and a plurality of credit indicia along said path, wherein an award of credits is dependent on encountering said credit indicia along said path wherein said award of credits is the sum of said credit indicia encountered by the player and said credit indicia encountered by the device along said path.

5. A gaming device, comprising, in combination:

a display, and a processor and random number generator operatively intercoupled and operatively coupled to said display, said random number generator providing an outcome to a primary game initiated on said display, said display having at least one outcome triggering a subsequent bonus event, said subsequent bonus event allowing play of a gaming proposition against the device, wherein the device is tangibly represented as an opponent, said play occurring as a function of random means, and wherein an award is generated based on relative final success against said opponent in said subsequent bonus event wherein said bonus event further comprises a path to be traversed by a player and a plurality of credit indicia along said path, wherein an award of credits is dependent on encountering said credit indicia along said path wherein each said credit indicia is extinguished if encountered by said device along said path.

* * * * *